US005305693A

United States Patent [19]

Johnson et al.

[11] Patent Number: 5,305,693

[45] Date of Patent: Apr. 26, 1994

[54] SYSTEM AND METHOD FOR EXTERNALLY CONTROLLED SPACING OF SELF PROPELLED VEHICLES ALONG A RAIL

[75] Inventors: Bruce S. Johnson, Burbank; Mark S. Mesko, Valencia, both of Calif.

[73] Assignee: The Walt Disney Company, Burbank, Calif.

[21] Appl. No.: 67,550

[22] Filed: May 26, 1993

[51] Int. Cl.[5] ..... B60L 15/00

[52] U.S. Cl. ..... 104/299; 104/300; 104/301; 246/187 R; 246/200 R; 246/182 R; 246/206

[58] Field of Search ..... 104/295, 299, 300, 301; 246/186, 187 R, 200 R, 182 R, 206

[56] References Cited

U.S. PATENT DOCUMENTS

| | | | |
|---|---|---|---|
| 881,637 | 3/1908 | Van Sant | 104/75 |
| 965,768 | 7/1910 | Van Sant | 104/75 |
| 1,357,995 | 11/1920 | Kitterman | 104/83 X |
| 1,450,669 | 4/1923 | Lalle et al. | 104/60 |
| 1,890,137 | 12/1932 | Traver | 104/63 |
| 2,196,093 | 4/1940 | Bartlett | 104/53 |
| 2,493,755 | 1/1950 | Ferill, Jr. | 246/182 RX |
| 2,576,424 | 11/1951 | Sunstein | 104/300 X |
| 3,261,302 | 7/1966 | Forsman | 246/206 X |
| 3,467,026 | 9/1969 | Broggie | 105/341 |
| 3,554,130 | 1/1971 | Broggie | 104/75 |
| 3,628,463 | 12/1971 | Kwiatkowski et al. | 104/295 X |
| 3,828,681 | 8/1974 | Christensen et al. | 104/299 X |
| 4,361,094 | 11/1982 | Schwarzkopf | 104/168 |
| 4,620,280 | 10/1986 | Conklin | 104/295 X |
| 4,928,601 | 5/1990 | Harder et al. | 104/53 |

*Primary Examiner*—Robert J. Oberleitner
*Assistant Examiner*—S. Joseph Morano
*Attorney, Agent, or Firm*—Pretty, Schroeder, Brueggemann & Clark

[57] ABSTRACT

A system and method for movement of self-propelled vehicles in-line along a rail under external control is intended to ensure safe spacing between vehicles to avoid collisions. Each vehicle is driven by its own variable speed motor. The speed of the vehicles is controlled by a stationary cam extending beside the rail. The edge of the cam rises and falls in a predetermined manner and is sensed by a cam follower on each vehicle. The cam follower is coupled to a transducer which produces a control signal for varying the vehicle speed in response to the rise or fall of the cam edge. Each vehicle pulls along a tail which extends behind the vehicle and is guided for motion alongside the edge of the cam. If a rear vehicle approaches a forward vehicle sufficiently closely for the cam follower of the rear vehicle to be raised from the cam edge by contact with the tail of the forward vehicle, the transducer of the rear vehicle is thereby caused to signal its drive motor to move the rear vehicle at a speed no faster than the forward vehicle, to avoid collision with it.

32 Claims, 8 Drawing Sheets

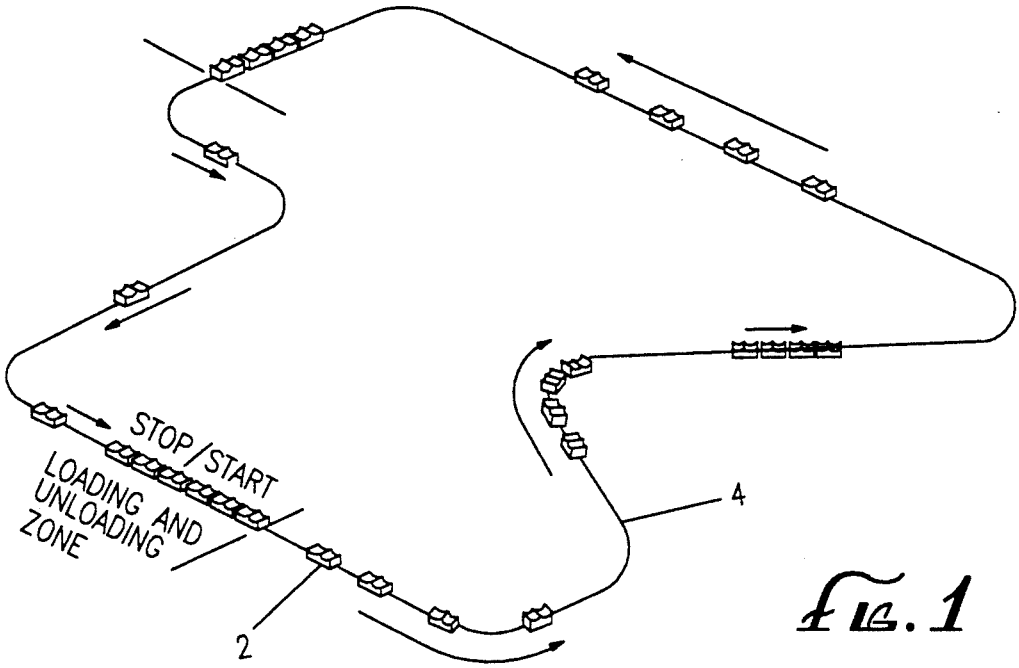
FIG. 1
FIG. 2
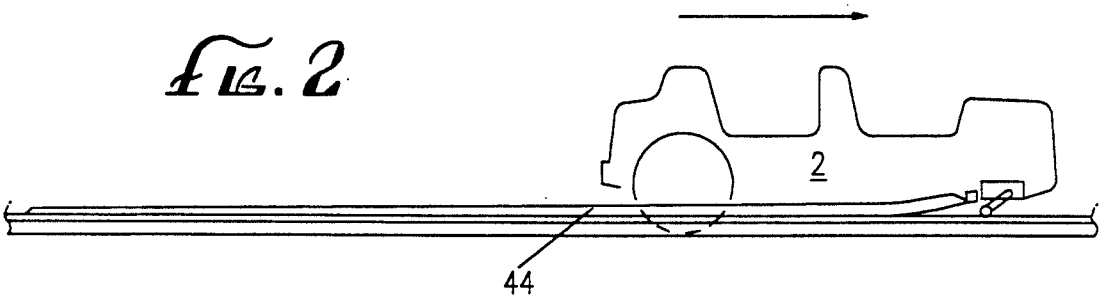
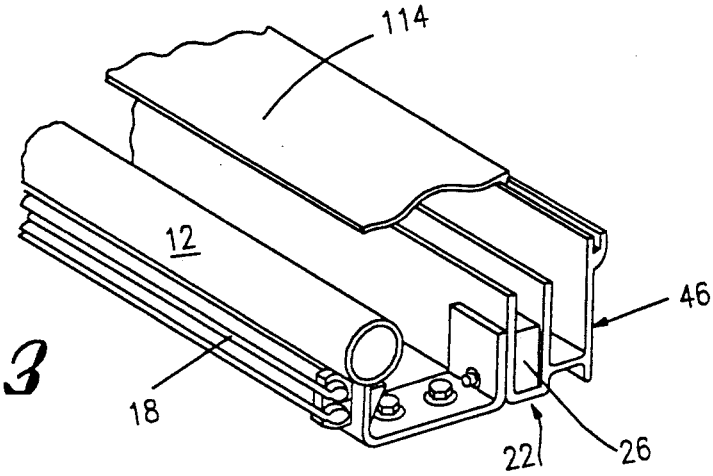
FIG. 3

SYSTEM AND METHOD FOR EXTERNALLY CONTROLLED SPACING OF SELF PROPELLED VEHICLES ALONG A RAIL

FIELD OF THE INVENTION

This invention relates to a system and method for movement of self-propelled vehicles in-line along a rail under external control, which is intended to ensure safe spacing between the vehicles.

BACKGROUND OF THE INVENTION

In amusement rides, it has long been known to use self-propelled vehicles guided by a track or rail along a predetermined path in which passengers are exposed to a variety of entertaining views or sensations. Typically, passengers (sometimes referred to as guests) will enter and leave the vehicles while they are standing still, or travelling very slowly, and then be transported at speeds which are varied along the length of the ride. With these ride systems, it is an important consideration to maintain a safe spacing between the vehicles to avoid collisions which could frighten or injure the passengers.

Accordingly, in amusement ride systems such as those operated by the assignee of the present invention, The Walt Disney Company, a control system is necessary to control the timing intervals between the loading of vehicles, the speeds of the vehicles along the ride, and most importantly, to prevent collisions between vehicles. Since the widespread availability of computers, control systems have typically involved dividing the ride path into predetermined zones, mounting sensors and stationary brakes in association with the guide rail or track, and using a computer system to monitor the locations of all vehicles, and prevent vehicles from entering zones until preceding vehicles are clear. Because passenger safety is involved, a vehicle control system based upon external vehicle tracking sensors and a computer, must be extremely reliable. This requires redundant sensors, redundant computers, and complex failure-detecting software, all of which is very expensive to install and maintain. For example, in smaller rides, the control system can often be more expensive than the track and the vehicles.

In earlier times, before the availability of computers, there were systems for control of self-propelled vehicles moving around a track in which a mechanical arrangement was used to reduce the risk of collision between vehicles. One such system is disclosed in a 1923 patent to Lalle et al., U.S. Pat. No. 1,450,669, which discloses a plurality of vehicles moving in-line along a track, each powered by its own electric motor. In the Lalle system, each vehicle was provided with a longitudinally extending control arm, mounted for pivoting motion in a vertical plane, extending forwardly beyond the front of the vehicle. The forward end of the control arm could contact an inclined skid secured to the rear frame of the preceding vehicle, if the vehicles approached each other too closely, to pivot the control arm upwardly and thereby break the electrical circuit to the rear vehicle and cause it to stop. The control arm, at its rear end, also had a horizontal lateral branch which extended vertically down at its free end. The free end would contact a vertically movable brake rail positioned alongside the track. A ride attendant, who watched all the vehicles in motion, could elevate the brake rail, if he saw that one vehicle was approaching another with likelihood of rear end collision, thereby pivoting the control arm to disconnect power from the vehicle.

While the system disclosed in the Lalle patent may have been satisfactory for its intended purpose half a century ago, present day ride operators have demands which would not be satisfied by such a system. Reliance on visual observation of the vehicles by the ride attendant and operation of a brake rail if the attendant observed that collision was imminent would not be satisfactory for present day rides due to the large number of vehicles that may be on a single ride, the circumstance that portions of the track may pass through areas hidden from visibility of the ride attendant, and the risk that the ride attendant's attention might become distracted at a time when collision avoidance was required. Moreover, the use of a brake rail to completely stop the approaching rear vehicle would involve sequential stopping of all vehicles following the arrested vehicle to avoid sequential collisions, thus bringing the ride to a temporary halt for all vehicles following the arrested vehicle. Under current ride operation practice, it is desired to slow the rearwardly approaching vehicle down relatively to the speed of the preceding vehicle instead of bringing it to a halt, in order to keep both vehicles travelling at the speed of the forward vehicle so that the track and vehicles can handle the maximum throughput at peak periods capable of being safely achieved without collision.

The other aspect of the Lalle system, its automatic anticollision system based on the pivoted control arm contacting the skid on the preceding vehicle, would also suffer from the same problem. Namely, it depended upon disconnecting the motor of the approaching rear vehicle entirely from power rather than slowing the rear vehicle down enough to prevent collision with the preceding vehicle but allowing it to maintain its travel without coming to a halt or unduly slowing down following vehicles. Furthermore, in the Lalle system, the rearwardly facing skid on each vehicle was short and sharply inclined so that the system had no capability for varying the safe spacing between vehicles dependent upon the speed at which the forward vehicle was traveling.

As well as the complexity and cost of modern day computer dependent ride control systems and the mechanical systems such as the Lalle patent, both types of prior system are time-consuming to install on-site. This can render them unsuitable for ride systems requiring rapidity and ease of assembly and disassembly such as travelling amusement fairs.

SUMMARY OF THE INVENTION

The system and method of the present invention are intended to overcome the problems and disadvantages of present day computer controlled ride systems and of the earlier mechanical systems described above. While the present invention will be described with particular reference to its applications for amusement park rides, the invention is of much broader application. It can be used, for example, for applications involving airport people movers or for movement of goods or materials, such assembly line operations, baggage handling or mining. It can also be used, in miniaturized form, for toys. These other applications are not intended to be exhaustive but merely to illustrate other uses.

The system of the present invention includes at least two vehicles contacting a rail for guidance along a predetermined path with the vehicles spaced in forward and rear relation to each other. Each vehicle is driven by a variable speed motor. A stationary cam is connected to the rail and extends parallel to the predetermined path. The cam has a cam edge which is spaced perpendicularly from the datum line along its length and varies in its spacing in a predetermined manner between a base level and a peak level spaced a maximum distance from the base level. A cam follower, mounted on each vehicle, is in sliding contact with the cam edge. The cam follower operates a transducer which provides the drive motor with a control signal which varies the speed of the vehicle so that, as the cam edge moves the cam follower further away from the base level, the vehicle speed is decreased, and vice versa. Each vehicle has a tail pulled behind it, guided for movement alongside the cam edge. The tail has an outer edge which includes at least a portion spaced a greater distance from the base level than the adjacent regions of the cam edge, projecting beyond it. If the vehicles come close enough together for the cam follower of the rear vehicle to be moved out of contact with the cam edge by the projecting portion of the outer edge of the tail of the forward vehicle, the transducer of the rear vehicle signals its driving motor to travel at a speed slower than the speed of the forward vehicle, thus avoiding collision, and causing the spacing between the vehicles to increase until the cam follower of the rear vehicle again contacts the cam edge. At this point, the rear vehicle's speed will have adjusted to match the forward vehicle's speed, and both vehicles will travel together.

The system of the present invention has many advantages. Significantly, the simple mechanical components of the system are much less expensive and far easier to make and assemble than systems based on a system of track sensors linked to computers for tracking the movement of vehicles. Moreover, unlike earlier mechanical systems which completely shut off power to the following vehicle, the present system allows both the forward and the rear vehicles to continue their motion at the speed of the forward vehicle, thereby increasing the throughput of vehicles along the track. This also reduces the risk of collision of further following vehicles or the need to bring them to a halt creating a stationary traffic line. If, however, the forward vehicle becomes disabled and comes to a complete stop on the track, all following vehicles will come to a safe stop behind it. Moreover, this system operates automatically without requiring manual observation and intervention of a ride attendant to slow down the rear vehicle in danger of collision.

A significant feature of the present invention is that the tail permits the spacing between the vehicles, at which collision avoidance commences, to be increased when the vehicles are travelling relatively fast and to be decreased when they are travelling relatively slowly. This feature is important because when the vehicles are travelling on high speed sections of the track, it is desirable to have increased spacing at the point when collision avoidance begins in order to avoid overrun due to momentum. In slow speed situations, such as when the vehicles are to be slowed down to move around a corner, the momentum of the vehicles is less and a closer spacing permits more vehicles to be handled on the track thereby increasing ride throughput. This variable spacing is achieved by having the outer edge of the tail inclined convergently to the base level in a forward to rear direction. When both vehicles are traveling alongside a portion of the cam edge which is at the base level, signalling relatively high speed travel, the part of the outer edge of the tail of the forward vehicle which intersects the cam edge will be spaced near the end of the tail, relatively far away from the end of the vehicle, to achieve maximum vehicle separation. As the forward vehicle moves onto a section of the path where the spacing of the cam edge from the base level increases, causing the forward vehicle to move more slowly, the point at which the outer edge of the tail intersects the cam edge will move forward, closer to the rear end of the forward vehicle, decreasing the spacing between the vehicles in recognition of the lower speed of the forward vehicle.

The system of the present invention also accommodates a ride path having curves in it. Specifically, the tail is made of a flexible plastic material which flexes to follow the contour of the cam as the cam curves to follow a bend in the predetermined path. Guidance of the tail is provided by a tail guide channel, mounted to the cam channel, which is also of U-shaped cross-section. The flexible tail is mounted within the channel of the tail guide.

In view of the importance of the tail to the avoidance of collisions, the present invention adds a valuable safety feature at the point of connection of the tail to the vehicle. Specifically, the tail is connected to the vehicle by a frangible connection which breaks apart at a lower force than the force needed to pull the tail apart between its ends. If the tail, in its movement along the path, encounters an obstruction impeding its progress, the frangible connection will break before the tail leaving the entire unbroken tail in the tail guide channel. As the next following vehicle approaches, its cam follower will ride up the exposed portion of the disconnected tail of the preceding vehicle until its cam follower is sufficiently far spaced from the base level to signal the drive motor of the following vehicle to stop its movement. In this way, if there should be a failure of the tail, it does not occur by breakage between its ends, which could be hazardous, but in a manner which ensures that the separated tail functions as a fail safe device to completely halt the progress of succeeding vehicles.

The invention also incorporates features which make it easy to assemble on site. Specifically, the cam itself takes the form of a generally U-shaped cam channel which can receive complementary elongate cam members. The cam members have their outer edge shaped to conform to the desired profile of the cam edge. The cam channel, the cam members, the guide rail and the tail guide channel are preassembled together in modular sections of differing lengths. The modular sections are made in straight sections and curved sections. To assemble the track for a particular ride, the preassembled modular sections can be assembled together, in curved and straight sections of different lengths, to provide the desired ride path. The ease of assembly and disassembly of the modular sections permits traveling shows to assemble and strike the track for an amusement ride with significantly less time, effort and expense compared to more complicated systems.

It is necessary to provide a loading and unloading zone for guests to board and deboard the vehicles, respectively. The invention accommodates this requirement by providing a moveable segment of the cam, positioned within the loading and unloading zone, which is movably mounted relatively to the remainder of the cam. In a stop position, the portion of the cam edge within the movable segment is spaced sufficiently far from the base level to cause any cam followers in contact with it to signal the associated vehicle to stop. Moreover, as other incoming vehicles approach the stopped vehicle, the tails on the vehicles will cause them to sequentially come to a stop forming a line of halted vehicles on the incoming side of the loading zone. In a start position, the portion of the cam edge within the movable segment is spaced at a lesser distance from the base level than the peak level, sufficient to cause the associated vehicle to commence moving. An actuator selectively moves the movable segment between its start and stop positions. With this arrangement, control of the passenger loading and unloading is easily effected. Also, different starting sequences for plural vehicles can readily be achieved, as will be later described.

These and other advantages of the invention are discussed more fully in the detailed description which follows.

BRIEF DESCRIPTION OF THE DRAWINGS

A system for externally controlled movement of self-propelled vehicles along a rail to ensure safe spacing, constructed in accordance with the preferred embodiment of the invention, is illustrated in the accompanying drawings in which:

FIG. 1 shows a plurality of externally controlled self-propelled vehicles moving along a guide rail which guides them in a predetermined path;

FIG. 2 is a side view of one of the vehicles showing an elongate flexible tail pulled along by the vehicle and extending behind it;

FIG. 3 is a perspective view of the guide rail showing an associated cam channel and tail guide channel;

An arrow in several of the preceding figures indicates the direction in which the vehicle is moving.

DETAILED DESCRIPTION

The system of the present invention (FIG. 1) is intended to control the movement of a plurality of self-propelled vehicles 2 around a predetermined path 4 in a way that varies the speed of the vehicles automatically at different regions along the track while avoiding collisions. For example, the vehicles may be externally controlled to slow going around tight corners and to accelerate as they move down straightaways. An important consequence of this arrangement is that the spacing of the vehicle changes proportionately to vehicle speed. The vehicular system will be described with reference to amusement park ride vehicles but is not to be considered so limited.

Figure 13:
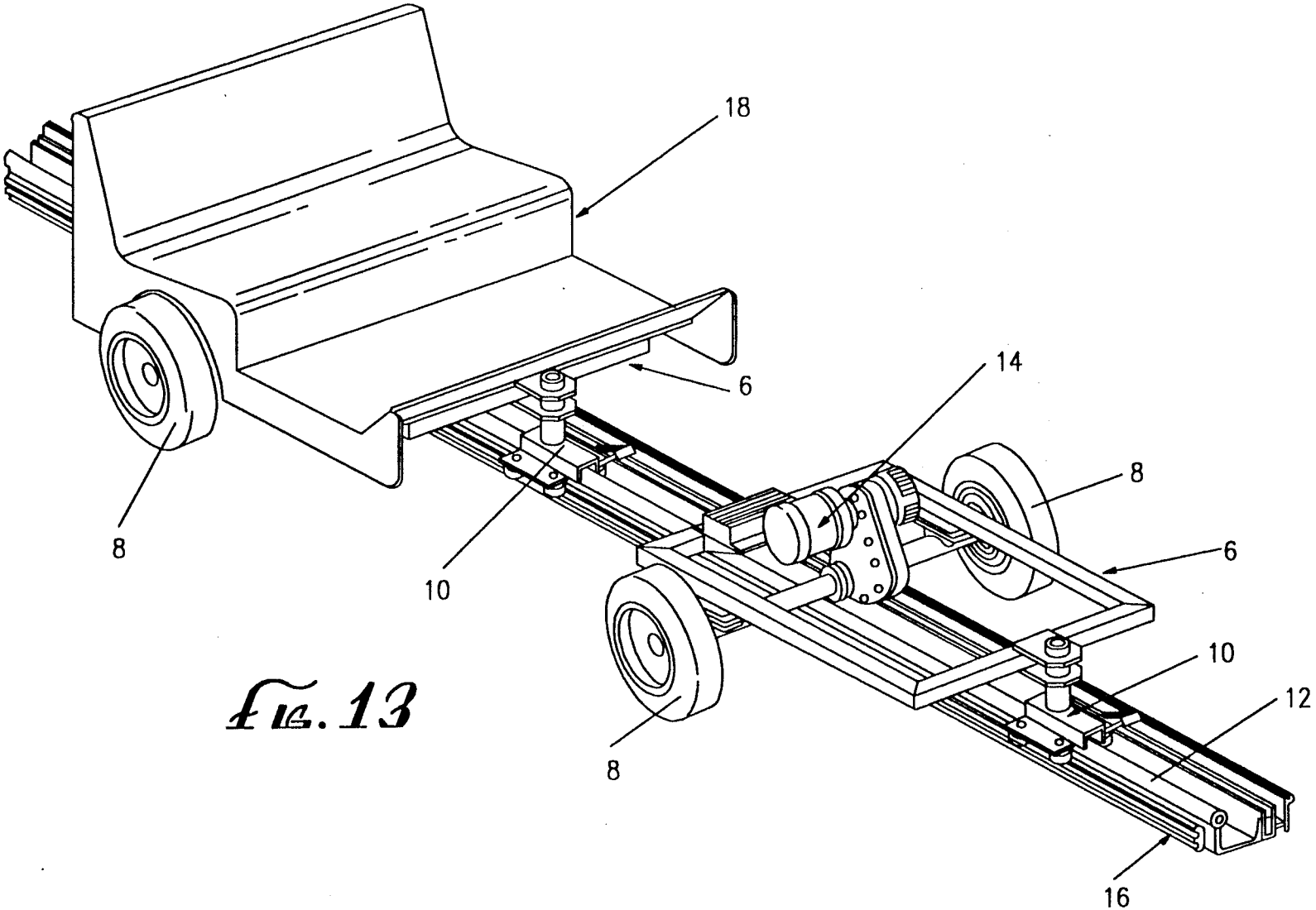
FIG. 13 is a perspective view of two of the vehicles shown in simplified format with the forward one of the vehicles having its body removed to reveal its chassis and drive train.

An exemplary ride vehicle (FIG. 13) includes a generally rectangular chassis 6 having a three point suspension defined by a pair of rear drive wheels 8 and a forward guide assembly 10. The guide assembly 10 engages a tubular guide rail 12 which extends around the predetermined path 4 to guide the vehicles along it. Conventional ground supporting structure extending between the guide rail and the ground (not shown) supports the guide rail along its length with the required strength and rigidity. The vehicle drive wheels are mounted to the chassis and are driven by a variable speed electric motor 14. Power for the electric motor is provided by a conventional busbar system in which parallel electric power conductors 16, which extend beneath and are secured to the guide rail 12, are connected to the electric motor by sliding electrical contacts (not shown). A conventional transmission system couples the drive motor 14 to the drive wheels. A passenger supporting body 18 is mounted on the chassis 6. The particular details of the chassis, drive wheels, drive motor and passenger supporting body do not form a part of the invention and many different configurations of vehicle will be readily apparent to those skilled in vehicle design. Rather, as will become apparent, the invention here resides in the system for external control of vehicle speed and for avoidance of collision.

Figure 6:
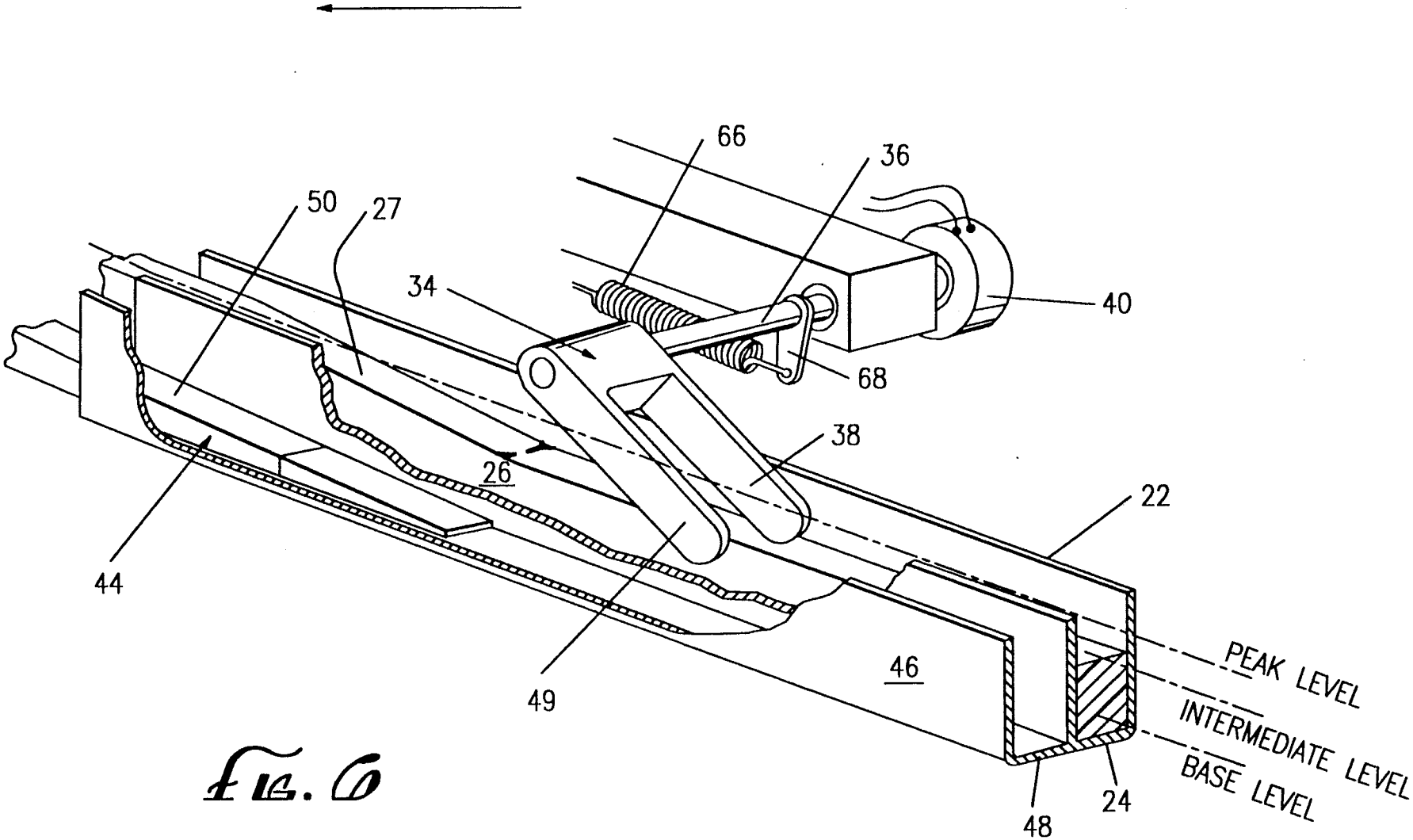
FIG. 6 is a perspective view, partially broken away, of a cam of predetermined contour, used for external control of vehicle speed as the vehicles travel along the rail, with a cam follower positioned to sense the cam and also to sense the tail of the preceding vehicle.

The speed of each vehicle as it moves around the track is externally controlled by a stationary elongate cam extending around and parallel to the path 4. The cam (FIG. 6) includes an upwardly open, U-shaped cam channel 22 defined by a horizontally and longitudinally extending base surface 24 and vertically extending sidewalls extending upwardly from opposite sides of the base surface. The cam channel is connected to the guide rail by conventional U-shaped brackets and extends along it (FIG. 3). Another part of the cam comprises elongate cam members 26 which fit within the cam channel resting on its base surface. Each elongate cam member has an outwardly facing edge spaced perpendicularly from the base surface 24 of the cam channel, with the spacing varying in a predetermined manner along the path (FIG. 6). The spacing of the outer edge of the cam member surface rises and falls, in a direction perpendicular to its length, from a base level, spaced closely above the base surface 24 of the cam channel, to a peak level spaced outwardly a maximum distance from the base level. The outer edges 27 of the various cam members 26 collectively constitute a continuous cam edge which rises and falls in a predetermined manner between the base and peak levels along the length of the predetermined path. The cam edge, as will be described, is used to control vehicle speed. Where the cam edge changes between base and peak levels, there are longitudinal transition regions inclined outwardly or inwardly between the levels.

Each vehicle, as it travels along the track, continuously senses the position of the cam edge by a cam follower 34 secured to one end of a shaft 36 rotatably mounted to the vehicle structure (FIG. 6). A first finger 38 forming part of the cam follower has its free end biased continuously into contact with the cam edge by a conventional spring biasing arrangement. The opposite end of the shaft 36 provides the mechanical input to a rotary transducer 40, specifically a potentiometer, which provides a control signal to control the speed at which the driving motor 14 drives the vehicle. The signal output of the transducer 40 controls the vehicle speed in inverse relation to the spacing of the cam edge from the base level 24. The transducer output signal instructs the drive motor to drive the vehicle at maximum speed when the cam follower is in contact with the base level 24 of the cam edge and it deactivates the drive motor when the cam follower senses the peak level of the cam edge. By placing appropriately configured sections of the elongate cam member 26 around the predetermined path, the vehicles can be instructed to slow down as they approach the curves and to accelerate out of the curves to maximum velocity on the straight ways, or to perform other patterns of fast and slow travel as desired. For example, the speed of travel may be slowed down as the vehicle passes through a particularly interesting scene and then accelerated between scenes to travel to the next interesting scene.

Figure 4:
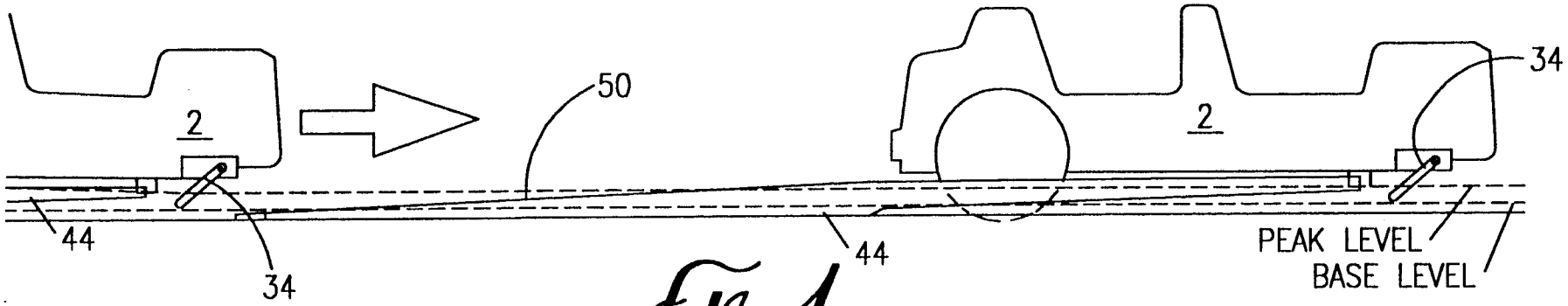
FIG. 4 is a side view showing two of the vehicles in movement along the guide rail with the rear vehicle moving in overtaking relation to the forward vehicle, with a dotted line showing of the relative position of a peak level and a base level of the rise and fall of a cam edge forming part of the invention.
Figure 5:
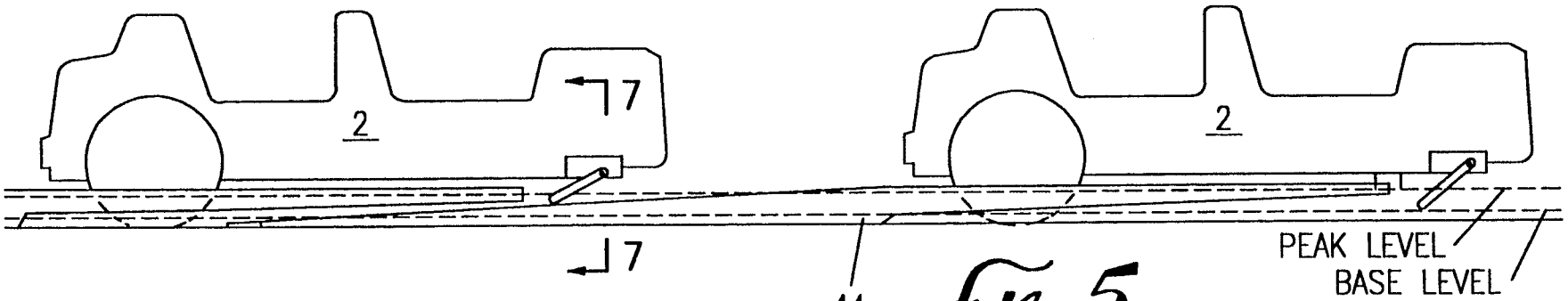
FIG. 5 is a view of the vehicles shown in FIG. 4 in which the rear vehicle senses the tail being towed by the forward vehicle and is caused thereby to reduce its speed to not more than the speed of the forward vehicle.

Collision avoidance to ensure guest safety is of paramount concern in such a system of externally controlled vehicles. Collision avoidance is effected according to the invention by providing each vehicle with an elongate tail 44 which is secured at its leading end to the underside of the vehicle, near its forward end, and extends rearwardly beneath the vehicle to be dragged along behind it (FIGS. 4 and 5). The tail on a forward one of the vehicles 2 (to the right in FIG. 4) prevents collision by a faster moving vehicle coming behind it. The tails 44 are received within a U-shaped tail guide channel 46 which extends alongside and parallel to the cam channel 22 (FIG. 6). The tail guide channel 46 has a horizontal, longitudinally extending base surface 48 and vertical spaced sidewalls, one of which is common with the cam channel. The tails are pulled along the tail guide channel 46 sliding on its base surface 48. Each tail 44 has an outer edge 50 which, at its high point behind the vehicle, is spaced above the peak level of the cam edge. For reference, the base level and the peak level of the cam edge are indicated by dotted lines on FIGS. 4 and 5. The cam outer edge can also be configured to extend at intermediate levels between the base level and peak level, as shown in FIG. 6. The tail outer edge extends rearwardly at a downward inclination 24 until its free rear end is positioned below the base level of the cam edge.

To achieve collision avoidance, the cam follower 34 on each vehicle includes a second finger 49 positioned to overlie the tail guide channel. The second finger 49 is coextensive and aligned with the first finger 38 in laterally spaced parallel relation to it. The second finger 49 of the cam follower contacts the tail of the preceding vehicle if two vehicles come too close together. As shown in FIG. 4, there is a point at which the inclined outer edge 50 of the tail of the forward vehicle projects above the adjacent region of the cam edge. This point will vary in distance from the back of the forward vehicle, dependent on the distance which the edge of the adjacent region of the cam is located above the base level. When the cam follower 34 of the rear vehicle reaches this point on the outer edge of the tail of the forward vehicle, further overtaking movement of the rear vehicle will cause the cam follower of the rear vehicle to rise higher up on the tail of the forward vehicle thereby rotating the shaft 36 relative to the transducer in the direction to signal the rear vehicle drive motor 14 to reduce the speed of the rear vehicle. Since the cam follower of the forward vehicle will not have been correspondingly raised, the forward vehicle will continue to travel at the speed at which it was already traveling without decreasing speed. Accordingly, the relative closing motion of the two vehicles will cease, preventing a collision, and the rear vehicle will slow to a speed slightly less than that of the forward vehicle. As a result, the spacing between the vehicles will increase until the cam follower 34 of the rear vehicle reaches the point at which the inclined outer edge 50 of the tail of the forward vehicle projects above the adjacent region of the cam edge. As the follower approaches this point, the rear vehicle's speed is increased by the downward motion of the follower until it equals the speed of the forward vehicle.

Significantly, the invention achieves collision avoidance without requiring the rear vehicle to have its drive motor completely disconnected from power as existed in the earlier mechanical system of the Lalle patent previously described. With the present invention, the rear vehicle continues to travel at the same speed, or little less, than the unreduced speed of the forward vehicle, thus maintaining effectively undiminished travel of both vehicles around the path. Also, this avoids the necessity to bring the rear vehicle to rest as well. This result is achieved without the necessity for a complicated system of track sensors and complex computer controls which more complicated, computer based ride systems require.

A significant feature of the present invention is that there is an automatic increase of the spacing between vehicles at which collision avoidance commences as the speed of the forward vehicle increases. This is because of the inverse relationship between the spacing of the cam edge and vehicle speed. When the vehicles are traveling slowly, the cam edge is spaced at a distance approaching the maximum peak level from the base level. Thus, the point at which the outer edge of the tail of the forward vehicle rises above the cam edge is relatively close to the rear end of the vehicle. As a result, the cam follower of the rear vehicle will not be raised from the cam edge, to thereby signal the rear vehicle to slow down, until the vehicles are relatively closely spaced from each other. In contrast, when the forward vehicle is moving at its maximum speed or close to it, the cam edge will be at, or close to, the base level respectively. Accordingly, the point at which the outer edge of the tail projects further away from the base level than the cam edge will occur much further back towards the end of the tail so that the point at which the cam follower of the rear vehicle will be raised from the cam edge is moved back closer to the end of the tail. As a consequence, at higher speed, the relative decrease of speed of the rear vehicle to the forward vehicle will commence when the vehicles are further spaced apart than they were at slower speed. The advantage of having the greater spacing at the higher speed is that it allows for the longer braking distance required by the higher speed of the rear vehicle as it loses momentum in the course of slowing down relative to the forward vehicle, to provide added safety for collision avoidance.

Figure 7:
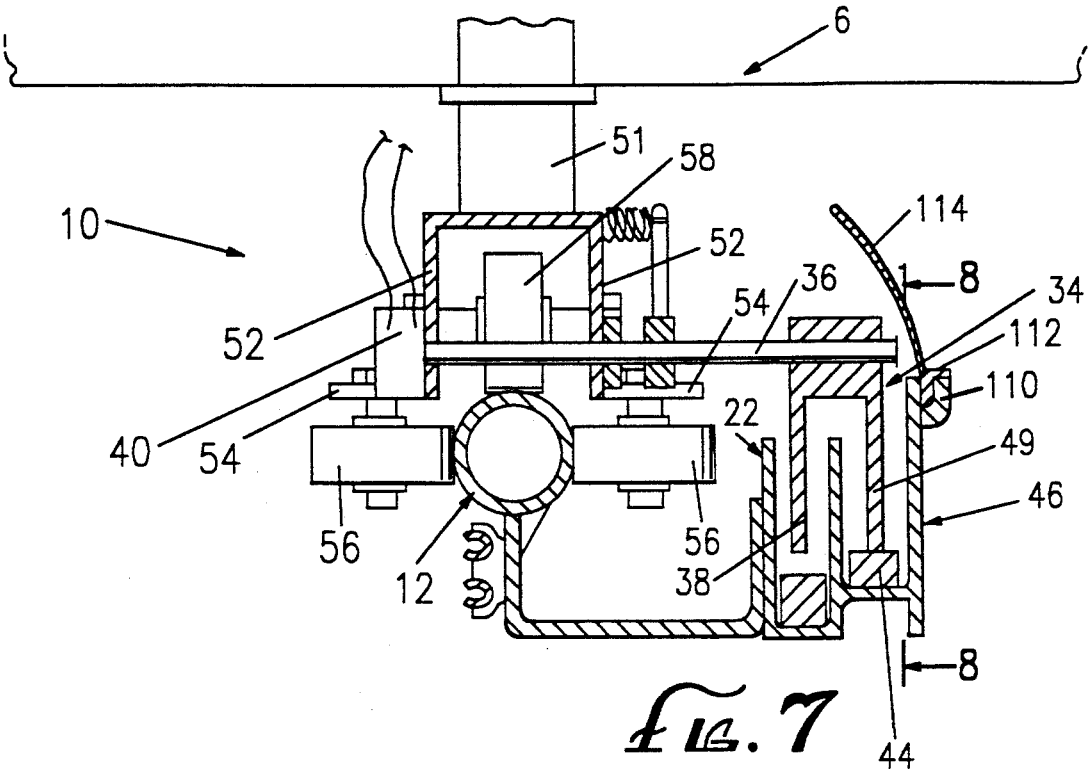
FIG. 7 is a cross-sectional end view of a portion of the guide rail and the front guide rail engaging assembly attached to the forward end of each of the guided vehicles, corresponding to the view shown in FIG. 5 taken along the lines 7—7 therein.
Figure 8:
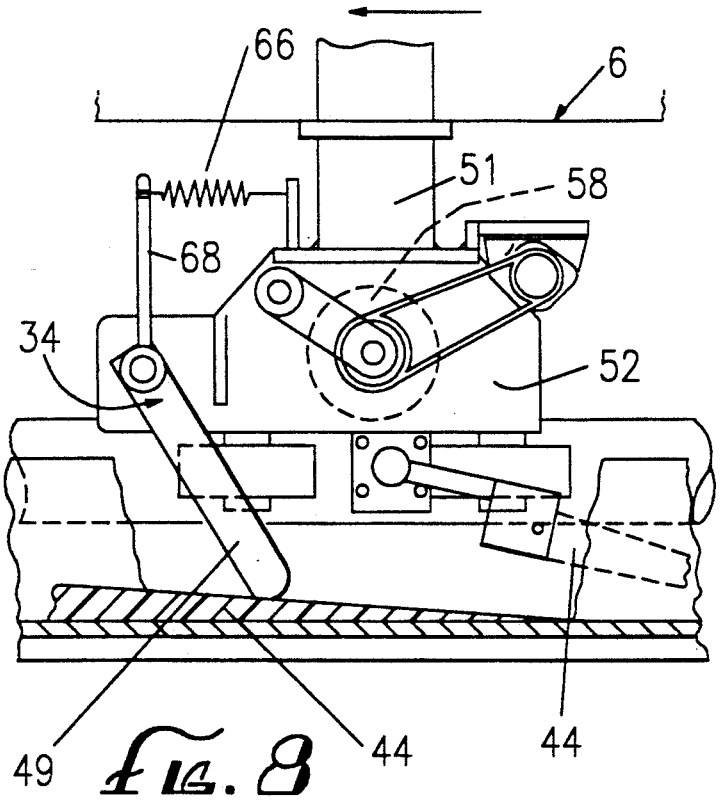
FIG. 8 is a cross-sectional side view of a portion of the system generally corresponding to that shown in FIG. 7 but viewed from the side.
Figure 9:
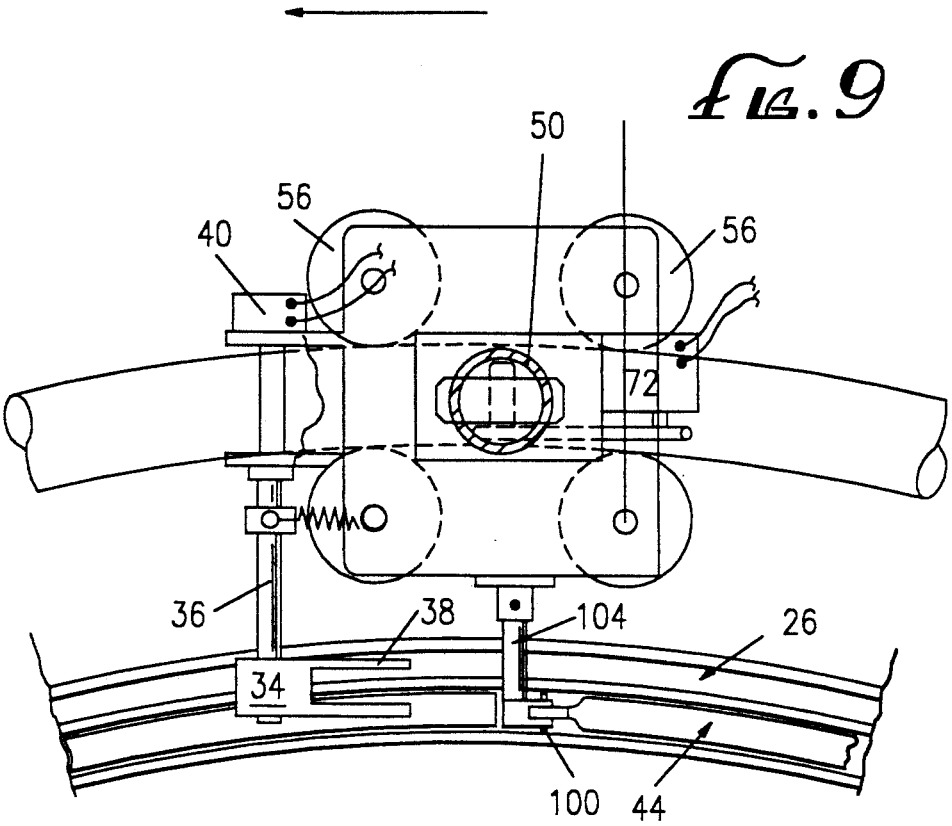
FIG. 9 is a simplified plan view of the portion of the vehicle guide system shown in FIGS. 7 and 8, looking vertically down thereon, to show the positioning of the cam follower for sensing the edges of the cam and of the tail of the preceding vehicle.
Figure 10:
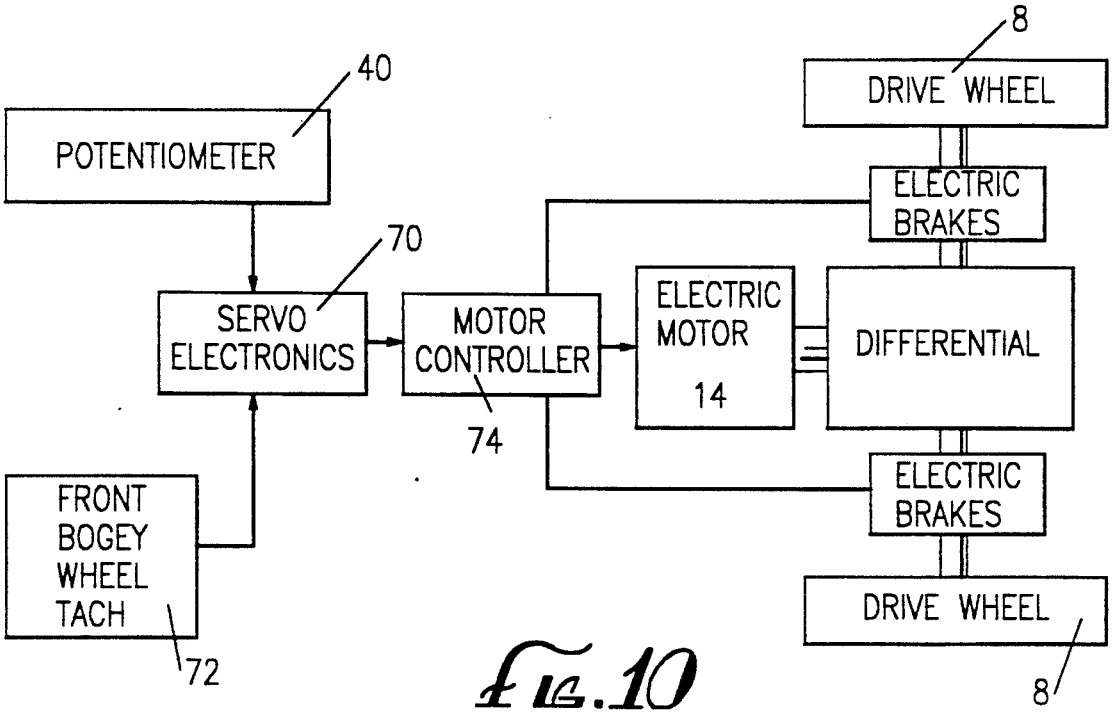
FIG. 10 is a simplified block diagram illustrating the electric motor drive system for each vehicle and the control equipment used to control the motor driving the vehicle and, hence, its speed along the track.

The foregoing structure is shown in additional detail in FIGS. 7–9. The guide assembly 10 includes a vertical shaft 51 depending from the center of the chassis 6 and supporting at its bottom end an elongate box-shape structure in the form of an inverted U having vertical sidewalls 52. The vertical sidewalls have outturned depending flanges 54 which mount horizontal rollers 56 that engage the guide rail 12 on its opposite sides. The sidewalls 52 also support a vertical roller 58 which engages at the top of the guide rail. The previously mentioned shaft 36 is rotatably mounted in the sidewalls 52, forwardly of the roller 58, and extends laterally. At one extremity, the shaft 36 enters the transducer 40 while its free extremity supports the cam follower 34. The cam follower has the two depending fingers 38 and 49 extending side-by-side in spaced, coextensive relation. The cam finger 49 enters the tail guide channel and is positioned to be contacted by any of the tails 44 as they move into proximity with it. The other finger 38 rests upon the cam edge until such time as it may be raised from it by contact of the finger 49 with one of the tails 44 in a collision avoidance situation (as shown in FIG. 7). The cam follower 34 is biased towards the cam edge by a tension spring 66 connected to an arm 68 mounted on the shaft 36 (FIG. 8). Movement of the cam fingers toward or away from the base surface rotates the input shaft to the potentiometer 40 to provide a varying control signal to the electric motor. The signal provided by the potentiometer instructing the vehicle to increase or decrease speed is input into a servo electronics unit 70. The servo electronics unit receives a second input proportional to the instantaneous speed of the vehicle derived from a tachometer 72 measuring the rate of rotation of the front top roller 58 (FIG. 10). The servo electronics unit derives a signal from these two inputs, which is used to instruct a motor controller 74 to signal the electric motor 14 to drive the drive wheels 8 at a speed bearing a predetermined relation to the spacing of the portion of the cam edge instantaneously sensed by the cam follower from the base level. The motor controller also will cause electric brakes to apply if the instructions from the potentiometer to decrease speed exceed the speed reducing capability of the electric motor 14. The particular details of the circuitry to implement the block diagram shown in FIG. 10 are conventional and within the skill of a person knowledgeable in the control of electric motor driven vehicles.

Figure 15:
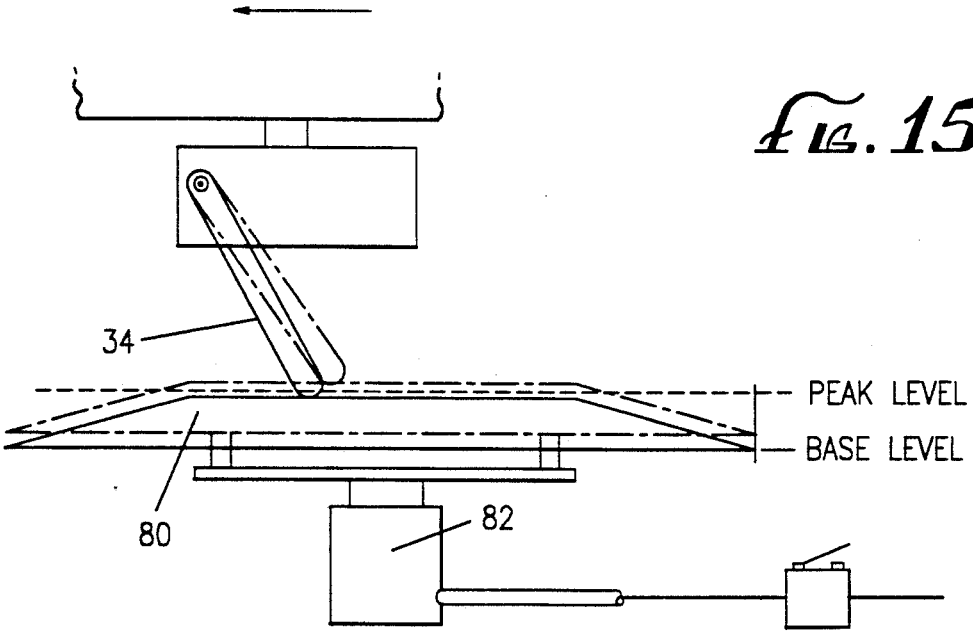
FIG. 15 shows a movable section of the stationary external control cam which is used to control the stopping and starting of vehicles in a loading and unloading zone.

The system of the invention includes a loading zone at which the vehicles are slowed to a stop to load and unload guests (FIGS. 1 and 15). To provide for deceleration of returning vehicles to a stopped condition, a movable cam segment 80 is mounted within the cam channel 22 in the loading and unloading zone. The movable segment is supported by an electrically operable solenoid 82 for selective up and down movement perpendicular to the base surface 24 of the cam channel between a START position and a STOP position, shown in full line and in phantom line, respectively, in FIG. 15. To bring vehicles entering the loading zone to a halt, the solenoid 82 is operated to elevate the movable cam segment 80 relative to the base of the cam channel until its upper surface is spaced above the peak level in the STOP position. As a result, as a returning vehicle enters the loading zone (shown moving right to left), the movable cam segment pivots the cam follower upwardly, away from the base level to beyond the peak level, thereby signalling the drive motor to cease driving the vehicle. The signal to cease rotation of the driving motor can be also used to apply the vehicle's brakes to halt the vehicle in the loading zone. As the next vehicle, following the halted vehicle, approaches the loading zone, its cam follower will contact the tail of the halted vehicle and be brought to a halt itself. The sequence will be repeated for following vehicles so that a chain of automatically stopped vehicles will build up on the input side of the loading zone permitting a group of vehicles to be loaded at one time.

When it is desired to restart the halted vehicle around the path, the solenoid 82 is retracted to move the movable cam segment 80 downwardly until its upper edge is spaced a little distance below the peak level but still remains a substantially greater distance away from the base level, as shown in full line in FIG. 15. In this condition, the cam follower pivots downwardly to a position in which the drive motor of the vehicle is signalled to commence movement at a slow pace. As the tip of the cam follower 34 reaches a forward end of the movable segment 80, it enters upon a downwardly inclined portion which continues until it reaches the base level of the cam corresponding to maximum speed of travel. During passage of the cam follower along the downwardly inclined portion of the outer edge of the movable segment 80, the vehicle is accelerated up to its maximum travel speed. The movable segment thus provides a simple and reliable speed controller for the vehicles in the loading and unloading, enabling each vehicle to be brought safely to a halt for unloading the passengers in the vehicle and loading of new passengers, followed by a gentle acceleration back to movement along the ride path 4.

The foregoing description has described only one of three restart modes in which the movable segment of the cam can be used to start a group of vehicles having their cam followers resting on the cam edge of the movable cam segment. As just described, if the cam edge of the movable cam section is moved straight down, with the cam edge kept parallel to the base level, the entire group of vehicles will be started together, gradually increasing spacing as they gain speed. In a first alternative mode, if the cam edge of the movable cam section is pulled down at a forward and downward inclination, the entire group of vehicles will be started together, rapidly increasing spacing as they gain speed. In a second alternative mode, if the movable cam signal is pulled down momentarily, the vehicles will be restarted one at a time, and the ones behind will automatically move up.

Figure 11:
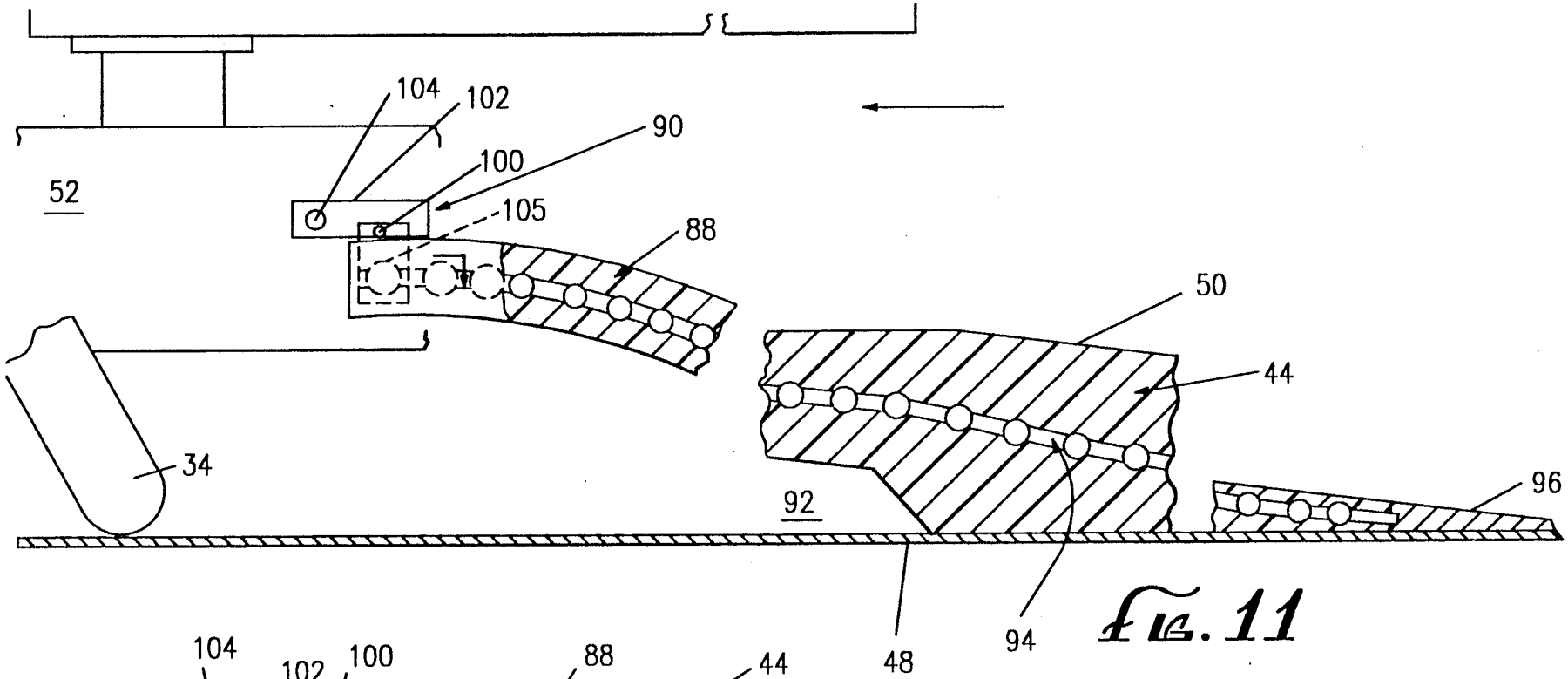
FIG. 11 is a cross-sectional fragmentary side view of the tail.
Figure 12:
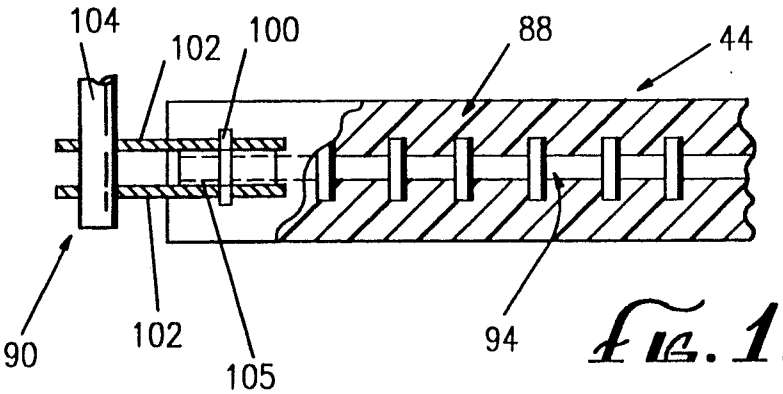
FIG. 12 is a cross-sectional top view of a portion of the tail showing its connection to the vehicle by a frangible pin.

The tail 44 which enables the above-described anticollision function, is made by casting polyurethane in a flat sided mold (FIGS. 11 and 12). The tail is elongate and includes a base edge 86, generally coextensive in length with the previously referred to outer edge 50, which slides upon the base surface 44 of the tail guide channel 46. The shape of the tail, beneath the outer edge 50 inclined downwardly to its rearward end, has already been described and does not need to be repeated. Extending forwardly from the inclined outer edge portion 50 is a neck region 88 of the tail. The neck region extends from a connection unit 90 mounted to one of the sidewalls 52, and extends rearwardly beneath the vehicle. Beneath the neck 88, extending back to the commencement of the base edge 86, there is a recess 92. The recess is long enough and has enough vertical height to allow the tail of the associated vehicle to move over the end of the tail of the preceding vehicle without interference throughout the range in which the vehicles are capable of relative closing motion without collision, as illustrated in FIG. 5. The flexibility of the tail allows it to bend around curves in the path followed by the tail guide channel. To reduce the sliding friction between the tail and the tail guide channel, in the preferred embodiment the tail guide channel is constructed of ultra high molecular weight (UHMW) polyurethane. To strengthen the tail and maintain its shape against longitudinal elongation caused by the friction of being dragged along the surface, a flexible metal reinforcing member 94 is incorporated into the polyurethane sheet material of the tail when the tail is initially cast. In the preferred embodiment, the reinforcing member 94 is a gear belt drive chain having laterally projecting spurs extending on both sides of the chain available under the trademark FLEX-E-BELT® from Berg Corporation of East Rockaway, N.Y. The tail is further reinforced against damage at its thinnest, end region by a hard plastic end portion 96, which is triangular as viewed from the side, constituting the end of the tail. The end portion 96 is secured to the member 94.

The connection unit contributes significantly to the safety of the anticollision system by incorporating a frangible link 100 which breaks if the tail encounters an obstruction in the tail guide channel. The cam follower 34 of the next following vehicle 2 will then ride up the inclined edge of the detached, stationary tail of the preceding vehicle until it is elevated to the height of the peak level above the base level, thereupon signalling the associated drive motor 14 to cease driving the vehicle. The frangible link 100 is mounted between side plates 102 which are connected to the end of a transverse shaft 104 mounted in the sidewalls 52 previously described. The frangible link passes through an opening in a metal plate 105 which is embedded within the forward end of the neck 88, projecting upwardly from it, and fixed to the front end of the cable 94. The frangible pin 100 is designed to fail at a lower force than the pulling force necessary to pull apart the tail 44 between its ends, thus ensuring the detachment of the tail as an unit. If the tail were capable of breaking apart between its ends, the risk would exist that the cam follower of the following vehicle could rise up and over the separated broken fragment of the tail of the preceding vehicle, and the following vehicle could then reaccelerate and collide with the preceding vehicle. By incorporating the frangible link, the invention ensures that a separating tail separates as a unit with its forward portion projecting above the peak level to bring the following vehicle to a complete halt and eliminate the risk of collision. This is an important fail safe feature of the invention which contributes to the overall elimination of collisions.

Another feature of the invention is a cover extending along the length of the cam channel 22 and the guide channel 46 to prevent the intrusion of foreign objects which might interfere with the sensing function of the cam fingers. For example, leaves and foreign objects such as pebbles or candies might fall into these channels and interfere with the operation described. As shown in FIG. 7, the outside wall of the tail guide channel 46 is provided with an integral lip 110 defining an upwardly facing U-shaped groove extending along the length of the tail guide channel. The groove in the lip 110 receives a molded resilient plastic cover having a flange 112, shaped to provide a snug compression fit within the opening in the lip 110, and an integrally hinged thin cover wall 114. The cover wall 114 is laterally wide enough to extend across both the tail guide channel 22 and the cam channel and rest upon the inner wall of the cam channel. A plow member (not shown) secured to the vehicle extends beneath the cover 114 in front of the cam follower 34 to raise the cover 114 out of the way as the cam follower passes. After the passage of the cam follower, the raised wall 114 falls back to its position overlying and covering the cam channel and the tail guide channel against entry of foreign objects. An additional advantage of the cover is that it hides the external control mechanism and tails from the guests, contributing to an entertaining illusion that the vehicle is moving under the control of an unseen influence. Openings are provided in the tail guide channel to enable the tail to expel foreign objects from the channel as it passes by.

Figure 14:
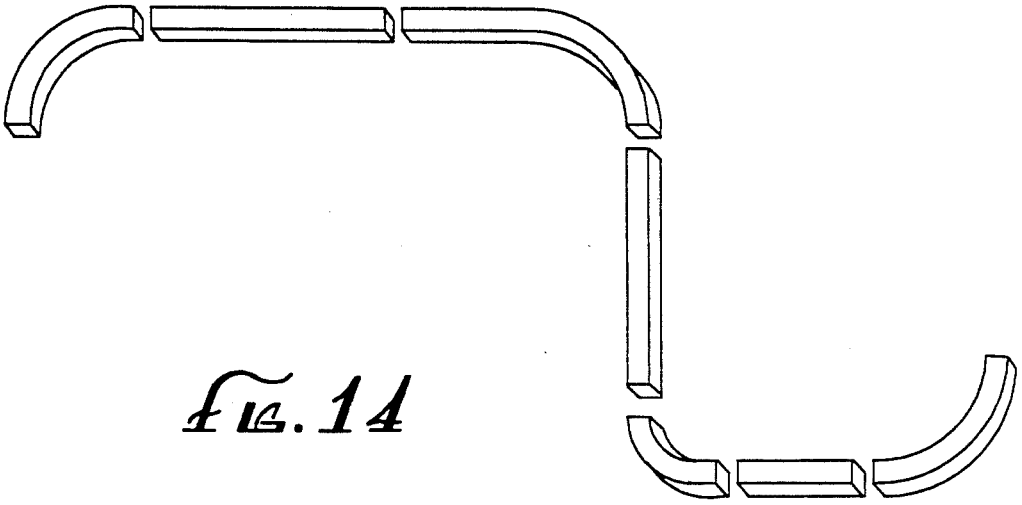
FIG. 14 illustrates the assembly of the track from a plurality of modular sections.

In assembling rides, it is advantageous for the ride operator if the track can be as easy to assemble and to strike as possible and capable of rearrangement in different configurations. With the present invention, sections of the track can be made up as modular segments in different lengths and with curves of opposite hand. Each segment includes a length of the guide rail, the electric power lines, the cam channel, the cam member, and the tail guide channel. The modular segments can be secured together by conventional securing devices such as brackets and bolts. With this arrangement, the track can be assembled into any desired ride configuration simply by securing together different modular segments in selected straight lengths and curves, as shown in FIG. 14. After the track has been put together, then a region of particular speed can easily be changed, if desired, by removing the initially installed cam member from the cam channel and replacing it with a differently contoured length of the cam member.

Although the system has thus far been described with reference to the preferred embodiment using a stationary cam mechanically sensed by a spring biased cam follower which turns the shaft of a rotary transducer to control vehicle speed, other cam sensing techniques may be used such as pneumatic, optical or electrical proximity sensors having an output to an appropriate type of transducer to produce a control signal for the drive motor. Also, the cam information, instead of being provided by rise and fall of the cam edge, could be provided on a constant level cam edge provided with coded indicia, such as bar codes or magnetically coded indicia, read by an optical or magnetic sensor, respectively, carried by the vehicle.

Although the invention has been thus far described with respect to a system, it will be appreciated that the invention also involves performance of a method. In the method, each vehicle is provided with a tail which extends behind the vehicle and is pulled along by it. The tails are guided for movement alongside the cam as the vehicles move along the rail. Each tail is contoured to have an outer edge facing outwardly in the same direction as the cam edge with at least a projecting portion of the outer edge of each tail being spaced a greater distance from the base level than the cam edge. If the vehicles come close enough together for the cam follower of the rear vehicle to be moved further away from the base level by the projecting portion of the outer edge of the tail of the forward vehicle than the cam follower of the forward vehicle resting upon the cam edge, the method involves causing the transducer of the rear vehicle to signal its drive motor to move the rear vehicle no faster than the forward vehicle. By practice of this method, the collisions are avoided while enabling the vehicles to continue moving safely with minimized interruption.

Although the invention has been described with reference to a preferred embodiment, it will be appreciated by those skilled in the art of designing vehicular systems involving control of self-propelled, rail controlled vehicles that changes in various details which have been described may be made without departing from the inventions defined in the appended claims.

I claim:

1. A vehicular system comprising, a rail extending in a predetermined path;

at least two vehicles contacting said rail and guided thereby for in-line motion along said path in a forward direction, said vehicles spaced in forward and rear relation to each other;

an elongate stationary cam connected to said rail extending parallel to said predetermined path, said cam having a cam edge which rises and falls in an inward and outward direction perpendicular to the length of said cam in a predetermined manner along its length between a base level and a peak level spaced a maximum distance outwardly from said base level;

each said vehicle including, variable speed driving means for driving said vehicle along said path at varying speed controlled by a control signal; a cam follower movably mounted on said vehicle biased into sliding contact with said cam edge;

a transducer connected to said cam follower for providing said control signal to said driving means, said transducer varying said control signal in response to the spacing of said cam follower from said base level to cause the speed of said vehicle to be decreased in response to increase in spacing of said cam follower away from said base level and vice versa;

an elongate tail connected to said vehicle extending rearwardly therefrom, said tail, along its length, having an outer edge spaced perpendicularly from said base level of said cam edge on the same side thereof;

a tail guide guiding each said tail for movement parallel to said base level with said outer edge of said tail positioned alongside said cam edge and with at least a projecting portion of its outer edge spaced a greater distance from said base level than the adjacent regions of said cam edge, said cam followers positioned to contact both said cam edge and said outer edges of said tails;

whereby, if said vehicles come close enough together for said cam follower of the rear said vehicle to be moved further away from said base level by the projecting portion of said outer edge of said tail of the forward said vehicle than said cam follower of the forward said vehicle resting on said cam edge, said transducer of the rear said vehicle signals the associated said driving means to move said rear vehicle at a speed no faster than the speed of the forward said vehicle.

2. A vehicular system as defined in claim 1 wherein said base level of cam edge positions each said cam follower in contact therewith to signal its associated said driving means to move its associated said vehicle at a maximum speed and wherein said peak level positions each said cam follower in contact therewith to signal its associated said driving means to cease to apply driving motion to its associated said vehicle.

3. A vehicular system as defined in claim 2 wherein said outer edge of said tail extends at an inclination rearwardly from a forward position on a level with said peak level to a rearward position on a level with said base level such inclination causing the spacing between said vehicles, at which the rear said vehicle is signalled to move no faster than the forward said vehicle, to vary depending upon the speed at which said cam edge is signalling the forward said vehicle to travel.

4. A vehicular system as defined in claim 2 wherein said cam further includes, a movable segment of said cam positioned within a loading and unloading zone of the predetermined path, mounted for motion relative to the remainder of said cam between, a stop position in which the portion of said cam edge within said movable segment is spaced sufficiently from said base level to cause any said cam follower in contact therewith to signal the associated said drive means to cease driving its associated said vehicle, and a start position in which the portion of said can edge within said movable segment is spaced at a lesser distance from said base level than said peak level sufficient to cause any said cam follower in contact therewith to signal its associated said vehicle to commence moving; and an actuator for selectively moving said movable segment between its stop and start positions.

5. A vehicular system as defined in claim 1 wherein said predetermined path includes curved regions and wherein said rail, said cam and said tail guide are correspondingly curved and wherein said tail is made of flexible sheet-like material which follows the contour of the curved regions of said tail guide.

6. A vehicular system as defined in claim 1 further including a frangible connection connecting each said tail to its associated said vehicle, said frangible connection breaking apart at a lower force than is needed to pull said tail apart intermediate its ends, whereby, in the event of an obstruction arresting the movement of said tail along said tail guide, said tail separates as an unbroken unit from its associated said vehicle.

7. A vehicular system as defined in claim 1 wherein, said stationary cam includes, a generally U-shaped cam channel having sidewalls and a base surface, said base surface coinciding with said base level of said cam edge; and at least one elongate cam member received within said cam channel extending therealong, said cam member having an outer edge constituting said cam edge, said cam member being comprised of a plurality of elongate sections, whereby a section may be selectively removed and replaced with another, differently configured section to change the speed in the region of the path controlled by said section.

8. A vehicular system as defined in claim 7 wherein, said tail guide comprises a generally U-shaped tail guide channel mounted alongside said cam channel and having sidewalls and a base surface, said base surface of said tail guide channel extending parallel to said base surface of said cam channel, said tails being slidably received within said tail guide channel resting on said base surface thereof.

9. A vehicular system as defined in claim 8 further including cover means overlying the open sides of said cam channel and said tail guide channel, said cover means for excluding foreign objects from said channels while permitting contact of said cam followers with said cam edges and with said outer edges of said tails.

10. A vehicular system as defined in claim 1 wherein, said transducer includes a rotatable shaft extending therefrom, rotation of said shaft changing the magnitude of said control signal, and wherein each said cam follower includes, two spaced parallel arms fixedly mounted in side-by-side relation on said shaft, one of said arms contacting said cam edge and the other of said arms positioned to be contacted by said outer edges of said tails, and means biasing said arms against said edges, wherein movement of each said cam follower in a direction which increases the spacing of said arms from said base level rotates said shaft in a direction which changes the signal in a manner to decrease speed and vice versa.

11. A vehicular system comprising, a rail extending in a predetermined path;

at least two vehicles contacting said rail and guided thereby for in-line motion along said path in a forward direction, said vehicle spaced in forward and rear relation to each other;

an elongate stationary cam channel connected to said rail extending parallel to said predetermined path, said cam channel having a U-shaped cross-section with a base surface and sidewalls;

an elongate cam member received within said cam channel extending therealong, said cam member having an outer cam edge spaced from said base surface of said cam channel, said cam edge rising and falling in an inward and outward direction perpendicular to the length of said cam in a predetermined manner along its length between a base level and a peak level spaced a maximum distance outwardly from said base level;

each said vehicle including, variable speed driving means for driving said vehicle along said path at varying speed controlled by a control signal;

a cam follower movably mounted on said vehicle biased into sliding contact with said cam edge;

a transducer connected to said cam follower for providing said control signal to said driving means, said transducer varying said control signal in response to the spacing of said cam follower from said base level to cause the speed of said vehicle to be decreased in response to increase in spacing of said cam follower away from said base level and vice versa;

an elongate tail connected to said vehicle extending rearwardly therefrom, said tail having an outer longitudinal edge;

a tail guide channel mounted alongside said cam channel, said tail guide channel being of generally U-shaped cross-section having side walls and a base surface, said tails being slidably received within said tail guide channel for movement parallel to said base level of said cam edge with said outer edges of said tails positioned alongside said cam edge and with at least a projecting portion of each said tail outer edge spaced a greater distance from said base level than the adjacent regions of said cam edge, said cam followers positioned to contact both said cam edge and said outer edges of said tails;

whereby, if said vehicles come close enough together for said cam follower of the rear said vehicle to be moved further away from said base surface of said cam channel by the projecting portion of said outer edge of said tail of the forward said vehicle than said cam follower of the forward said vehicle resting on said cam edge, said transducer of the rear said vehicle signals said driving means of the rear said vehicle to move at a speed no faster than the speed of said forward vehicle.

12. A vehicular system as defined in claim 11 wherein said base level of said cam positions each said cam follower in contact therewith to signal its associated said driving means to move its associated said vehicle at a maximum speed and wherein said peak level positions each said cam follower in contact therewith to signal its associated said driving means to cease to apply driving motion to its associated said vehicle.

13. A vehicular system as defined in claim 12 wherein said cam further includes, a movable segment of said cam positioned within a loading zone of the predetermined path, mounted for motion relative said cam channel, a stop position in which the portion of said cam edge within said movable segment is spaced sufficiently from said base surface to cause any said cam follower in contact therewith to signal the associated said drive means to cease driving its associated said vehicle, and a start position in which the portion of said can edge within said movable segment is spaced at a lesser distance from said base surface of said cam channel than said peak level sufficient to cause any said cam follower in contact therewith to signal its associated said vehicle to commence moving; and an actuator for selectively moving said movable segment between its stop and start positions.

14. A vehicular system as defined in claim 11 wherein said outer edge of said tail extends at an inclination rearwardly from a forward position on a level with said peak level to a rearward position on a level with said base level, such inclination causing the spacing between said vehicles, at which the rear said vehicle is signalled to move no faster than the forward said vehicle, to vary depending upon the speed at which said cam edge is signalling the forward said vehicle to travel.

15. A vehicular system as defined in claim 11 wherein said predetermined path includes curved regions and wherein said rail, said cam channel, said cam member, and said tail guide channel are correspondingly curved and wherein said tail guide is made of flexible sheet-like material capable of flexing along its length to accommodate movement around sections of said tail guide channel defining a curve in said predetermined path.

16. A vehicular system as defined in claim 11 wherein said rail, said cam channel, said cam member and said tail guide channel are preassembled together in curved modular sections and straight modular sections of varying lengths which can be selectively arranged and connected to create different shapes for said predetermined path.

17. A vehicular system as defined in claim 11 wherein said cam channel and said elongate cam member have complementary generally rectangular cross sections to enable said elongate cam member to be located within said cam channel at any desired location and supported therein.

18. A vehicular system as defined in claim 11 further including a frangible connection connecting each said tail to its associated said vehicle, said frangible connection breaking apart at a lower force than is needed to pull said tail apart intermediate its ends, whereby in the event of an obstruction arresting the movement of said tail along said tail guide, said tail separates as a unbroken unit from its associated said vehicle.

19. A vehicular system as defined in claim 11 further including cover means overlying the open sides of said cam channel and said tail guide channel, said cover means for excluding foreign objects from said channels while permitting contact of said cam followers with said cam edges and with said outer edges of said tails.

20. A vehicular system as defined in claim 11 wherein each said tail includes a recess in its lower edge extending rearwardly from its forward end, said recess enabling said tail to move over a rear region of said tail of the preceding said vehicle without coming into contact therewith.

21. A tail for use in a vehicular system for avoiding collision between forward and rear vehicles moving in-line along a rail, wherein the speed of each vehicle is controlled by a stationary cam which extends alongside the rail with each vehicle having a movably mounted cam follower which slidably contacts an edge of the cam, each vehicle being driven by a drive motor at a speed determined by a transducer which acts to control the drive motor in response to the movement of the associated cam follower on the edge of the cam to cause each vehicle to be driven at a speed responsive to the position of its cam follower on the cam edge, the tail being attached to at least the forward vehicle and pulled thereby along a tail guide channel extending in a path alongside the cam, the tail of the forward vehicle elevating the cam follower of the rear vehicle from the cam edge when the vehicles come close enough together, the raising of the cam follower of the rear vehicle from the cam edge causing the transducer of the rear vehicle to control the rear vehicle to move no faster than the speed of the forward vehicle thereby avoiding collision, the tail comprising, a flexible sheet-like body extending in a lengthwise direction, said body having, an elongate base edge supporting said body for sliding motion along the tail guide channel, and;

an outer edge spaced in opposition to said base edge, said outer edge having a sloped region extending from a position adjacent the forward end of said tail to the rear end thereof, said sloped region extending from a maximum spacing from said base edge adjacent the forward end convergently towards the rear end, said base edge being supported by the tail guide channel such that at least a portion of said sloped region of said outer edge projects beyond the edge of the cam.

22. A tail as defined in claim 21 wherein said tail body is made from flexible sheet polyurethane.

23. A tail as defined in claim 21 further including a recess in said elongate base edge extending rearwardly from the forward end thereof for a portion of its length, said recess enabling said tail to move over the tail of the preceding vehicle without contact therewith for a predetermined range of motion.

24. A tail as defined in claim 21 further including, a flexible elongate metal core extending from the forward to the rear end of said body embedded internally thereof; and an end piece of harder material than said body connected to said core mounted to the rear end of said body.

25. A tail as defined in claim 24 further including, a neck region extending forwardly from said sloped region to the forward end of said body;

a frangible member connecting said neck region of said tail to said vehicle, said frangible member failing upon application of a pulling force to said tail caused by obstruction of the movement thereof which is less than the pulling force to break said tail apart intermediate its ends.

26. A vehicular system comprising, a rail extending in a predetermined path;

at least two vehicles contacting said rail and guided thereby for in-line motion along said path in a forward direction, said vehicles spaced in forward and rear relation to each other;

an elongate stationary cam connected to said rail extending parallel to said predetermined path, said cam having a cam edge which provides sensible information related to the speed at which a vehicle traveling along the track should travel varying in a predetermined manner along the length of the path;

each said vehicle including, variable speed driving means for driving said vehicle along said path at varying speed controlled by a control signal;

sensing means mounted on said vehicle for sensing the sensible information provided by said cam and providing said control signal to said driving means to cause it to drive said vehicle at a speed determined by the sensible information provided by said cam;

an elongate tail connected to said vehicle extending rearwardly therefrom, said tail, along its length, having an outer edge also provided with sensible information sensible by said sensing means;

a tail guide guiding each said tail for movement parallel to said base level with said outer edge of said tail positioned alongside said cam edge;

said sensing means of the rear said vehicle also sensing the sensible information provided on said tail of the forward said vehicle when said rear vehicle approaches said forward vehicle closely enough for said sensing means of the rear said vehicle to be positioned over said tail of the forward said vehicle, said sensing means comparing the information sensed from the region of said cam edge adjacent said rear vehicle with the information sensed from said tail of said forward vehicle for providing a control signal to said driving means of the rear said vehicle to move at a speed no faster than the speed of the forward said vehicle.

27. A method of avoiding collision between forward and rear vehicles moving in-line along a rail, wherein the speed of each vehicle is controlled by a stationary cam which extends alongside the rail with each vehicle having a movably mounted cam follower which slidably contacts an edge of the cam which rises and falls in an inward and outward direction perpendicular to its length in a predetermined manner therealong between a base level and a peak level spaced at a maximum distance outward from the base level, each vehicle being driven by a drive motor at a speed determined by a transducer which controls the drive motor in response to the movement of the associated cam follower on the edge of the cam thereby causing each vehicle to be driven at a speed inversely responsive to the spacing of its cam follower from the base level, the method comprising the steps of, providing each vehicle with a tail which extends behind the vehicle and is pulled along by it;

guiding the tails for movement alongside the cam as the vehicles move along the rail;

contouring each tail to have an outer edge facing outwardly in the same direction as the cam edge with at least a projecting portion of the outer edge of each tail spaced a greater distance from the base level than the cam edge; and if the vehicles come close enough together for the cam follower of the rear vehicle to be moved further away from the base level by the projecting portion of the outer edge of the tail of the forward vehicle than the cam follower of the forward vehicle resting upon the cam edge, causing the transducer of the rear vehicle to signal its drive motor to move the rear vehicle no faster than the forward vehicle.

28. The method as defined in claim 27 wherein the stationary cam includes a movable stop-start section which is selectively movable in a direction perpendicular to the length of the cam, the method including the further step of, positioning the stop-start section of the cam at a level such that its edge contacted by said cam followers is below said peak level thereby enabling travel of the vehicles past the stop-start section; and selectively moving the stop-start section of the cam outwardly to a stop position in which its edge is spaced at least at the peak level from the base level to cause vehicles entering the stop-start region to be stopped.

29. The method as defined in claim 28 wherein, with vehicles positioned over the stop-start section in a stopped condition and with the edge of the movable section positioned at the peak level, the method includes a subsequent step of, selectively moving the cam edge of the movable cam section inwardly from the peak level towards the base level to cause the stopped vehicles to start moving.

30. The method as defined in claim 29 wherein the step of inwardly moving the movable cam section is performed while maintaining its cam edge parallel to the base level to cause all vehicles positioned over the movable cam section to be started together and gradually increase their spacing as they increase speed.

31. The method as defined in claim 29 wherein the step of inwardly moving the movable cam section is performed by moving its edge to a position inclined inwardly and forwardly from and below the peak level to cause all vehicles positioned over the movable cam section to be started together and to rapidly increase their spacing as they gain speed.

32. The method as defined in claim 29 wherein the step of inwardly moving the movable cam section is performed as a step of short in and out pulses of motion between the peak level and a position spaced inwardly from the peak level, to cause the vehicles to be started one at a time and released to the remainder of the cam while the vehicles behind the one released automatically move up.

* * * * *